US008083613B2

(12) United States Patent
Sato et al.

(10) Patent No.: US 8,083,613 B2
(45) Date of Patent: Dec. 27, 2011

(54) GOLF BALL

(75) Inventors: Katsunori Sato, Chichibu (JP); Takuma Nakagawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 222 days.

(21) Appl. No.: 12/358,601

(22) Filed: Jan. 23, 2009

(65) Prior Publication Data

US 2010/0190581 A1 Jul. 29, 2010

(51) Int. Cl.
*A63B 37/06* (2006.01)

(52) U.S. Cl. ..... 473/383

(58) Field of Classification Search ..... 473/383–385, 473/373, 374

See application file for complete search history.

(56) References Cited

U.S. PATENT DOCUMENTS

| | | | | |
|---|---|---|---|---|
| 5,601,503 | A * | 2/1997 | Yamagishi et al. | 473/384 |
| 5,782,702 | A | 7/1998 | Yamagishi et al. | |
| 5,782,703 | A | 7/1998 | Yamagishi et al. | |
| 6,726,579 | B2 * | 4/2004 | Ohama et al. | 473/374 |

FOREIGN PATENT DOCUMENTS

| | | | |
|---|---|---|---|
| JP | 5-103846 | A | 4/1993 |
| JP | 10-43342 | A | 2/1998 |
| JP | 10-43343 | A | 2/1998 |
| JP | 2000-107338 | A | 4/2000 |

OTHER PUBLICATIONS

DuPont Surlyn 8945 Thermoplastic Ionomer Resin material data sheet.*

* cited by examiner

*Primary Examiner* — Raeann Gorden
(74) *Attorney, Agent, or Firm* — Sughrue Mion, PLLC

(57) ABSTRACT

The invention provides a golf ball with a surface having a plurality of dimples formed thereon. The number of dimples is at least 250 and not more than 400, the dimples have a surface coverage (SR) of at least 70% and a volume ratio (VR) of at least 1.1%, are of at least three types and have an average depth of at least about 0.18 mm and a diameter (DM) to depth (DP) ratio (DM/DP) of not more than about 22. The (total number of Db)/(total number of Da) ratio, where Da represents dimples having a diameter of at least 3.7 mm and Db represents dimples having a diameter of less than 3.7 mm, is at least about 0.005 and not more than about 1. The ball has a coefficient of lift CL at a Reynolds number of 70,000 and a spin rate of 2,000 rpm which is maintained at 60% or more of the coefficient of lift CL at a Reynolds number of 80,000 and a spin rate of 2,000 rpm. The golf ball of the invention lowers fluctuations in lift and drag at high and low spin rates, enabling a stable trajectory to be achieved.

12 Claims, 4 Drawing Sheets

DIMPLES IN EXAMPLE 1

DIMPLES IN COMPARATIVE EXAMPLE 1

DIMPLES IN COMPARATIVE EXAMPLE 2

DIMPLES IN COMPARATIVE EXAMPLE 3

DIMPLES IN COMPARATIVE EXAMPLE 4

GOLF BALL

BACKGROUND OF THE INVENTION

The present invention relates to a golf ball having a surface formed of numerous recessed dimples. More specifically, the invention relates to a golf ball which, by lowering fluctuations in lift and drag at high and low spin rates, is thus able to achieve a stable trajectory.

With recent advances in golfing equipment such as balls and clubs, it is not unusual for golf balls to be struck under low-spin conditions. However, depending on differences between golfers in the spin rate of a ball struck with a driver, substantial disparities in the distance traveled sometimes arise. To the amateur golfer in particular, because hitting the ball with a driver under low-spin conditions remains a challenge, the outcome is inconsistent—the ball will travel well at times and travel poorly at other times. In addition, when golfing, one has to deal constantly with wind conditions such tailwinds and headwinds. Accordingly, there exists a desire for the development of golf balls which minimize differences in flight performance under such conditions and increase a player's sense of stability.

A variety of golf balls have already been disclosed which, by optimizing the dimples on the surface of the ball, lower the flight trajectory and hold down decreases in distance.

For example, JP-A 05-103846 describes a golf ball in which the dimple diameter, dimple depth and number of dimples have been optimized. JP-A 10-043342 and JP-A 10-043343 disclose golf balls in which the amount of deformation by a ball when subjected to a load of 100 kg has been set to an appropriate value, the dimple diameter divided by the dimple depth has been set to from 10 to 15, and the dimple space volume as a proportion of the total volume of a hypothetical sphere were the ball to have no dimples on the surface thereof has been set to from 0.7 to 1.1%. JP-A 2000-107338 discloses a practice golf ball in which the ball weight and diameter have been optimized.

However, in the foregoing prior-art golf balls, the dimples have been optimized only for relatively high-spin conditions; the ball trajectory at low spin rates has been less than satisfactory.

It is therefore an object of the present invention to provide a golf ball which, by lowering fluctuations in lift and drag at high and low spin rates, is able to achieve a stable trajectory.

SUMMARY OF THE INVENTION

The inventors have conducted extensive investigations in order to achieve the above object. As a result, they have found that by constructing a golf ball in which even more conditions are imposed on the dimples formed on the ball surface than in the existing art, such as specifying the number of dimples, the dimple surface coverage (SR), the dimple volume ratio (VR), dimple types, the average dimple depth and the dimple diameter DM to depth DP ratio (DM/DP), and specifying also the ratio between the total number of dimples Da having a diameter of at least 3.7 mm and the total number of dimples Db having a diameter of less than 3.7 mm (total number of Db/total number of Da), and in which the ball has a coefficient of lift CL at a Reynolds number of 70,000 and a spin rate of 2,000 rpm that is maintained to at least a given ratio with respect to the ball coefficient of lift CL at a Reynolds number of 80,000 and a spin rate of 2,000, fluctuations in lift and drag at high and low spin rates are smaller and the ball trajectory stabilizes.

Accordingly, the invention provides the following golf balls.

[1] A golf ball comprising a surface having a plurality of dimples formed thereon, wherein the number of dimples is at least 250 and not more than 400, the dimples have a surface coverage (SR) of at least 70% and a volume ratio (VR) of at least 1.1%, are of at least three types and have an average depth of at least about 0.18 mm and a diameter to depth ratio (DM/DP) of not more than about 22, the (total number of Db)/(total number of Da) ratio, where Da represents dimples having a diameter of at least 3.7 mm and Db represents dimples having a diameter of less than 3.7 mm, is at least about 0.005 and not more than about 1, and the ball has a coefficient of lift CL at a Reynolds number of 70,000 and a spin rate of 2,000 rpm which is maintained at 60% or more of the coefficient of lift CL at a Reynolds number of 80,000 and a spin rate of 2,000 rpm.

[2] The golf ball of [1], wherein the dimples Da having a diameter of at least 3.7 mm account for at least about 75% of the total dimple volume.

[3] The golf ball of [1] further comprising a core, a cover layer, and an intermediate layer interposed therebetween, wherein the intermediate layer is composed of at least one layer made of a material having a material hardness (Shore D) of from 55 to 75.

[4] The golf ball of [3], wherein the cover layer is made of a material which is an ionomer resin.

[5] The golf ball of [3], wherein the core has a diameter of from 36.8 to 41.8 mm and has a deflection, when compressed under a final load of 130 kg from an initial load of 10 kg, of from 3.5 to 5.0 mm.

[6] A golf ball comprising a surface having a plurality of dimples formed thereon, wherein the number of dimples is at least 250 and not more than 400, the dimples have a surface coverage (SR) of at least 70% and a volume ratio (VR) of at least 1.1%, are of at least five types and have an average depth of at least about 0.18 mm and a diameter (DM) to depth (DP) ratio (DM/DP) of not more than about 22, the (total number of Db)/(total number of Da) ratio, where Da represents dimples having a diameter of at least 3.7 mm and Db represents dimples having a diameter of less than 3.7 mm, is at least about 0.005 and not more than about 1, the dimples DA having a diameter of at least 3.7 mm account for at least about 75% of the total volume of all dimples, and the ball has a coefficient of lift CL at a Reynolds number of 70,000 and a spin rate of 2,000 rpm which is maintained at 60% or more of the coefficient of lift CL at a Reynolds number of 80,000 and a spin rate of 2,000 rpm, and wherein the ball further comprises a core, a cover layer and an intermediate layer interposed therebetween, the core having a deflection, when compressed under a final load of 130 kg from an initial load of 10 kg, of from 3.5 to 5.0 mm, and the cover layer containing an ionomeric or urethane resin and having a material hardness (Shore D) of from 55 to 75 and a thickness of from 0.7 to 2.0 mm.

BRIEF DESCRIPTION OF THE DIAGRAMS

DETAILED DESCRIPTION OF THE INVENTION

The golf ball of the invention is described more fully below.

Figure 1:
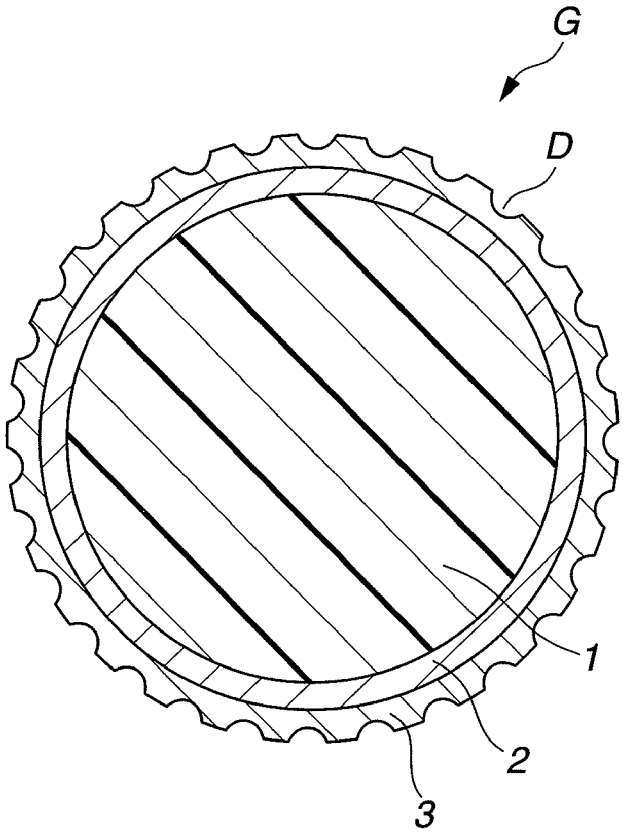
FIG. 1 is a cross-sectional view showing the internal construction of a golf ball according to an embodiment of the invention.

The golf ball of the invention has a surface formed of a plurality of recessed dimples. By imposing specific conditions on the dimples, fluctuations in lift and drag at high and low spin rates are reduced, enabling a stable trajectory to be achieved. The internal construction of the inventive golf ball, while not subject to any particular limitation, generally includes a core with a cover of one, two or more layers thereon. In particular, advantageous use may be made of a ball having a core, an outermost cover layer, and an intermediate layer interposed therebetween. That is, referring to FIG. 1, the ball is preferably formed so as to have a construction of three of more layers composed of a core 1, an intermediate layer encasing the core 1, and at least one cover layer 3 encasing the intermediate layer 2. The intermediate layer and cover layer are referred to collectively as the "cover." A plurality of dimples D are formed on the surface of the cover layer 3, which dimples satisfy the parameters of the invention. In FIG. 1, the golf ball is shown as being composed of one layer each of the core 1, intermediate layer 2 and cover layer 3, although any of these components may consist of two or more layers. If necessary, the core 1, the intermediate layer 2 and the cover layer 3 may each be composed of a plurality of layers.

The core in the invention may be formed using a rubber composition containing, for example, a base rubber and also such ingredients as a co-crosslinking agent, an organic peroxide, an inert filler and an organosulfur compound. The base rubber of the rubber composition is preferably one composed primarily of a known polybutadiene. In the present invention, it is desirable to include sulfur with the base rubber, the amount of sulfur included per 100 parts by weight of the base rubber being typically from 0.05 to 0.5 part by weight, preferably from 0.07 to 0.3 part by weight, and more preferably from 0.09 to 0.2 part by weight. If the amount of sulfur is too small, it may not be possible to achieve a sufficient hardness difference between the surface and center of the core. On the other hand, if the amount of sulfur is too large, the core may have too low a rebound, possibly resulting in a low rebound for the ball as well and, in turn, a poor distance.

In the present invention, it is preferable to include an organosulfur compound with the base rubber. The amount of organosulfur compound included per 100 parts by weight of the base rubber is typically from 0.05 to 5 parts by weight, preferably from 0.1 to 4 parts by weight, and more preferably from 0.2 to 2 parts by weight. If the amount of organosulfur compound included in the core is too low, the core may have too low a rebound, possibly resulting in a low rebound for the ball as well and, in turn, a poor distance. On the other hand, if too much organosulfur compound is included, the core hardness may become too low, resulting in a poor feel when the ball is played and a poor durability to cracking on repeated impact.

In addition, optimizing the ratio between the amounts of the above organosulfur compound and sulfur included is desirable for increasing the rebound of the molded core. Specifically, the (amount of organosulfur compound/amount of sulfur) ratio is preferably at least 1 but not more than 30, more preferably at least 3 but not more than 25, and even more preferably at least 5 but not more than 20. If this value is too small, the ball rebound may become low, resulting in a poor distance. On the other hand, if the value is too high, the ball hardness may become too low or the hardness difference between the surface and the center of the core may be insufficient, possibly resulting in an excessive rise in the spin rate and a loss in the desired effects of the invention.

The core diameter, while not subject to any particular limitation, is preferably at least 35.0 mm, more preferably at least 36.8 mm, and even more preferably at least 37.2 mm. The upper limit in the core diameter is preferably not more than 41.8 mm, and more preferably not more than 40.8 mm. The core has a deflection, as measured when compressed under a final load of 130 kgf from an initial load of 10 kgf, of preferably at least 2.5 mm, more preferably at least 3.0 mm, and even more preferably at least 3.3 mm. The upper limit in the core deflection is preferably not more than 5.5 mm, more preferably not more than 5.0 mm, even more preferably not more than 4.5 mm, and most preferably not more than 4.0 mm. If the core is harder than the above range, the spin rate may rise excessively, which is unsuitable for the dimples in the present invention. On the other hand, if the core is softer than the above range, the rebound may be too low, as a result of which the ball may have a poor distance, too soft a feel, and a poor durability to cracking on repeated impact.

The core surface has a hardness, as measured with a type D durometer based on ASTM D2240 (referred to below as "type D durometer hardness"), of at least 45 but not more than 65, preferably at least 50 but not more than 62, and more preferably at least 53 but not more than 60. If the core surface is harder than the above range, the spin rate may rise excessively, which is unsuitable for the dimples of the invention. On the other hand, if the core surface is softer than the above range, the rebound may be too low, resulting in a poor distance, the feel on impact may be too soft, and the ball may have a poor durability to cracking on repeated impact.

By using the above material, the rebound performance of the golf ball can be increased. As a result, it is possible to provide a golf ball which can achieve a good distance and which is also able to achieve a stable trajectory.

Next, the intermediate layer material is described. The intermediate layer material, while not subject to any particular limitation, may be a commonly used ionomeric or other type of thermoplastic resin or any of various types of thermoplastic elastomers. The use of the following type of resin composition is especially preferred. That is, it is preferable to use a resin composition which includes:

(A) an ionomeric resin containing
  - (a-1) an olefin-unsaturated carboxylic acid random copolymer and/or a metal ion neutralization product of an olefin-unsaturated carboxylic acid random copolymer, and
  - (a-2) an olefin-unsaturated carboxylic acid-unsaturated carboxylic acid ester ternary random copolymer and/or a metal ion neutralization product of an olefin-unsaturated carboxylic acid-unsaturated carboxylic acid ester ternary random copolymer in a weight ratio (a-1)/(a-2) of between 100/0 and 0/100, and (B) a non-ionomeric thermoplastic elastomer in a weight ratio (A)/(B) of between 100/0 and 50/50. It is more preferable to use a mixture obtained by blending 100 parts by weight of a resin component composed of the above ionomer resin (A) and the above non-ionomeric thermoplastic elastomer (B) in a weight ratio (A)/(B) of between 100/0 and 50/50 with:

(C) from 5 to 150 parts by weight of an organic fatty acid and/or derivative thereof having a molecular weight of from 280 to 1500, and (D) from 0.1 to 10 parts by weight of a basic inorganic metal compound capable of neutralizing un-neutralized acid groups in the above resin component and above component (C).

By using the above material, the rebound performance of the golf ball can be increased. As a result, it is possible to provide a golf ball that is capable of traveling a good distance and is also able to achieve a stable trajectory, which is the object of the invention.

It is preferable for the golf ball of the invention to have at least one intermediate layer which is made of the above resin material and has a Shore D hardness of at least 55 but not more than 75. If the above resin material is too much softer than the above range, the ball rebound may decrease, which may be unsuitable for the dimples of the invention. On the other hand, if the above resin material is too much harder than the above range, the durability to cracking on repeated impact may worsen.

The thickness of the intermediate layer, while not subject to any particular limitation, is preferably at least about 1.5 mm, and more preferably at least about 2.1 mm. The upper limit is preferably not more than about 5.0 mm, more preferably not more than about 4.5 mm, and even more preferably not more than about 4.0 mm. Setting the intermediate layer to a sufficient thickness in this way enables a sphere having the intermediate layer to exhibit sufficient rebound and enables the durability to be enhanced. However, if the intermediate layer is too thick, improper filling by the resin material tends to occur, which is undesirable.

Next, when the intermediate layer is formed of the above heated mixture, the cover layer serving as the outermost layer may be formed of a known material. A thermoplastic resin or the like may be used for this purpose. Examples of other suitable materials include ionomeric resins and various types of thermoplastic elastomers. Illustrative examples of thermoplastic elastomers that may be used include polyester-type thermoplastic elastomers, polyamide-type thermoplastic elastomers, polyurethane-type thermoplastic elastomers, olefin-type thermoplastic elastomers and styrene-type thermoplastic elastomers. It is especially preferable to use an ionomeric resin or a polyurethane-type thermoplastic elastomer as the cover layer material. Commercial products that may be used as the ionomeric resin include those available under the designations Himilan (from DuPont-Mitsui Polychemicals Co., Ltd.), Surlyn (E. I. DuPont de Nemours & Co.), Iotek (Exxon) and T-8190 (Dainippon Ink & Chemicals, Inc.). In the present invention, the rebound performance of the golf ball can be elicited by using an ionomeric resin. As a result, it is possible to obtain a golf ball which travels a sufficient distance and is also able to achieve a stable trajectory.

The thickness of the cover layer in the present invention, while not subject to any particular limitation, may be set to preferably at least about 0.3 mm, more preferably at least about 0.5 mm, and even more preferably at least about 0.7 mm. It is recommended that the upper limit be not more than about 3.0 mm, preferably not more than about 2.5 mm, even more preferably not more than about 2.3 mm, and most preferably not more than 2.0 mm. If the cover layer is too thin, the ball will have an inferior durability and cracking will tend to arise. On the other hand, if the cover layer is too thick, the ball may have a poor feel on impact.

The inventive ball has the following dimple parameters (1) to (8). In cases where, following formation of the cover, etc., the ball surface is subjected to finishing treatment (e.g., finishing treatment such as painting and stamping) or the like, these parameters are calculated based on the shapes of dimples on the final golf ball product in which all such treatment has been completed.

Dimple Parameter (1)

Numerous dimples are formed on the surface of the cover. The number of dimples here is set to at least 250 but not more than 400, with the upper limit being preferably not more than 350. In this range, the ball readily incurs lift, enabling the ball to travel farther, particularly on shots with a driver.

Dimple Parameter (2)

To improve aerodynamic performance, it is critical for the dimple surface coverage (SR), defined as the sum of the surface areas on a hypothetical sphere that are circumscribed by the edges of the respective dimples as a proportion of the surface area of the hypothetical sphere, to be at least 70%.

Dimple Parameter (3)

To improve the aerodynamic performance, it is critical for the dimple volume ratio (VR), defined as the sum of the volumes of individual dimple spaces below a flat plane circumscribed by the edge of each dimple on a golf ball as a proportion of the volume of the golf ball were it to have no dimples on the surface (hypothetical sphere), to be at least 1.1%.

Dimple Parameter (4)

The dimples of the present invention are of at least three types, preferably at least four types, and more preferably at least five types, but preferably not more than 14 types, of mutually differing diameter and/or depth. The number of types of such dimples is selected as appropriate for facilitating an increase in the surface coverage SR specified in the invention.

Dimple Parameter (5)

"Average dimple depth" refers to the average of the depths of all the dimples. To obtain a suitable trajectory, the average dimple depth is set to at least about 0.18 mm, and preferably at least 0.19 mm, but not more than about 1.0 mm. The depth DP of a dimple is measured by connecting the positions where the dimple meets land areas to trace a hypothetical flat plane L and determining the vertical distance from a center position on the flat plane L to the bottom (deepest position) of the dimple.

Figure 2:
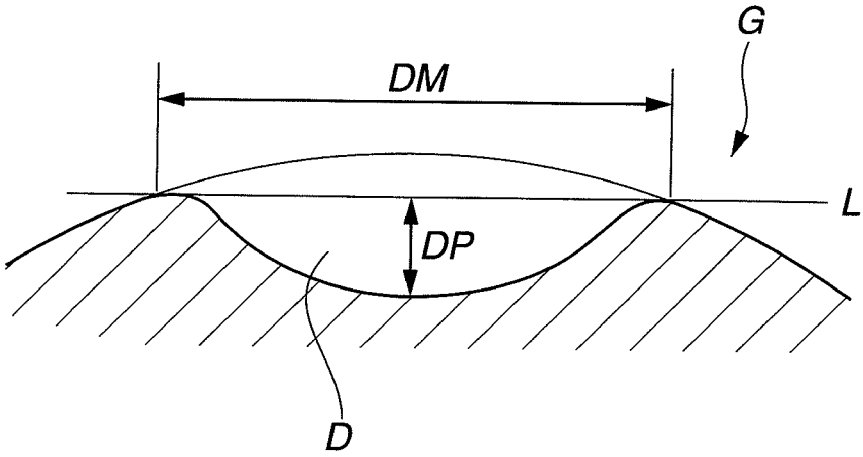
FIG. 2 is a schematic view illustrating a dimple used in the invention.

The average dimple diameter DM, while not subject to any particular limitation, is preferably at least about 3.0 mm, more preferably at least about 3.2 mm, and even more preferably at least about 3.5 mm, but preferably not more than about 7.5 mm, more preferably not more than about 6.5 mm, and even more preferably not more than about 6 mm. "Average dimple diameter DM" refers to the average of the diameters of all the dimples. The dimple diameter DM is measured by determining, as shown in FIG. 2, the diameter (span) DM between positions where the dimple portion is tangent with land areas (non-dimple forming portions), i.e., between the high points of the dimple portion. In most cases, the golf ball has been painted. In such balls, the dimple diameter and depth are determined after the coat of paint has been applied.

Dimple Parameter (6)

The ratio of the dimple diameter to the dimple depth, or DM/DP, has an average value of not more than about 22, and preferably not more than about 20. The lower limit, while not subject to any particular limitation, is preferably at least about 5, and more preferably at least about 8.

Dimple Parameter (7)

When the dimples are divided into dimples Da having a diameter of 3.7 mm or more, and smaller dimples Db, the (total number of Da)/(total number of Db) ratio is set to at least about 0.005 but not more than about 1. The lower limit is preferably at least about 0.01, and more preferably at least about 0.1, and the upper limit is preferably not more than about 0.8, and more preferably not more than about 0.6.

The dimples Da having a diameter of at least 3.7 mm account for a proportion of the total dimple volume which, while not subject to any particular limitation, is preferably at least about 75%, more preferably at least about 78%, and even more preferably at least about 80%. The upper limit value is preferably not more than about 98%.

The average diameter (Dm) of the Da dimples is preferably at least about 3.7 mm, and more preferably at least about 3.8 mm, but preferably not more than about 7 mm, and more preferably not more than about 6 mm. The average depth (Dp) of the Da dimples is preferably at least about 0.05 mm, and more preferably at least about 0.1 mm, but preferably not more than about 0.5 mm, and more preferably not more than about 0.3 mm. The average volume of the Da dimples is preferably at least about 0.8 $mm^3$, and more preferably at least about 1.0 $mm^3$, but preferably not more than about 3.0 $mm^3$, and more preferably not more than about 2.5 $mm^3$. The ratio Dm/Dp for the Da dimples is preferably at least about 7, and more preferably at least about 8, but preferably not more than about 25, and more preferably not more than about 23. If the above numerical value ranges are not satisfied, sufficient aerodynamic properties cannot be obtained, as a result of which it will not be possible to achieve a good distance and a stable trajectory.

The average diameter (Dm) of the Db dimples is preferably at least about 1 mm, and more preferably at least about 2 mm, but preferably not more than about 3.7 mm, and more preferably not more than about 3.5 mm. The average depth (Dp) of the Db dimples is preferably at least about 0.05 mm, and more preferably at least about 0.1 mm, but preferably not more than about 0.3 mm, and more preferably not more than about 0.2 mm. The average volume of the Db dimples is preferably at least about 0.2 $mm^3$, and more preferably at least about 0.3 $mm^3$, but preferably not more than about 1.5 $mm^3$, and more preferably not more than about 1.0 $mm^3$. The ratio Dm/Dp for the Db dimples is preferably at least about 10, and more preferably at least about 12, but preferably not more than about 30, and more preferably not more than about 26. If the above numerical value ranges are not satisfied, sufficient aerodynamic properties cannot be obtained, as a result of which it will not be possible to achieve a good distance and a stable trajectory.

Dimple Parameter (8)

To improve the distance a golf ball travels, it is desirable for the ball to have a low coefficient of drag (CD) under high-velocity conditions and a high coefficient of lift (CL) under low-velocity conditions. Thus, with regard to the low-velocity CL, it is critical here for the coefficient of lift CL when the ball is launched using an Ultra Ball Launcher (UBL) at a Reynolds number of 70,000 and a spin rate of 2,000 rpm to be maintained at 60% or more, and preferably at 65% or more, of the coefficient of lift CL at a Reynolds number of 80,000 and a spin rate of 2,000.

The dimple shapes are not subject to any particular limitation, and may be, for example, circular, polygonal, tear-shaped, oval or noncircular. The number of dimple types is set to be at least three, and preferably at least five, thereby enabling at least a given proportion of the spherical surface to be covered. By interspersing large and small dimples, the surface coverage can be increased to the specified range. Because this makes it possible to suppress extreme fluctuations in the coefficient of lift CL within the low-velocity region, a ball trajectory stabilizing effect is achieved.

The golf ball of the invention, so long as it has the above-described construction, is not subject to any particular limitations concerning other constituent features, and may be a solid golf ball such as a two-piece golf ball or a multi-piece golf ball having a construction of three or more layers. Ball properties such as weight and diameter may be suitably set according to the Rules of Golf. The ball may generally be formed so as to have a diameter of not less than 42.67 mm.

As described above, the golf ball of the invention reduces fluctuations in lift and drag at high and low spin rates, enabling a stable trajectory and distance to be achieved.

EXAMPLES

The following Examples and Comparative Examples are provided by way of illustration and not by way of limitation.

Example 1

Comparative Examples 1 to 4

Core compositions formulated as shown below were prepared, then molded and vulcanized to produce solid cores.

The core compositions were formulated as shown below. These rubber compositions were molded and vulcanized for 15 minutes at 155° C., thereby producing cores for the working example of the invention and each of the comparative examples. The core properties are shown in the table below.

| Core Formulation | |
|---|---|
| Base rubber (trade name "BR730," produced by JSR Corp.) | 100 parts by weight |
| Zinc acrylate | 37.5 parts by weight |
| Organic peroxide | 3 parts by weight |
| Zinc oxide | 20.46 parts by weight |
| Zinc salt of pentachlorothiophenol | 1.5 parts by weight |
| Sulfur | 0.1 part by weight |
| Zinc stearate | 5 parts by weight |

Core Properties

The diameter of the cores was 37.3 mm. The deflection of the cores when compressed under a final load of 130 kgf from an initial load of 10 kgf was 3.2 mm.

The intermediate layer material mentioned below was injection-molded over the above core, thereby giving a sphere composed of a core encased by a 1.65 mm thick intermediate layer.

Intermediate Layer Material

A resin material obtained by adding 5 wt % of "Dynaron 6100P" (available under this trade name from JSR Corporation) to "HPF 2000" (available under this trade name from DuPont).

Next, a 1.03 mm thick cover layer was injection-molded as described below over the resulting sphere, thereby giving a three-piece solid golf ball.

Cover Layer Material

One part by weight of polyethylene wax available from Sanyo Chemical Industries under the trade name "Sanwax 161-PKH" was blended into a resin base prepared by blending "Himilan 1605," "Himilan 1706" and "Himilan AM7329" (all products available under these trade names from DuPont-Mitsui Polychemicals Co., Ltd.) in a weight ratio of 50:25:25.

Simultaneous with injection molding of the cover layer, numerous dimples were formed on the surface of the cover, after which the cover layer was spray-painted. In each example and comparative example, the dimples were formed so that, after painting, they satisfied the parameters shown in the tables below. In the tables, the dimple type Da refers to dimples having a diameter of 3.7 mm or more, and the dimple type Db refers to dimples having a diameter of less than 3.7 mm.

Figure 3:
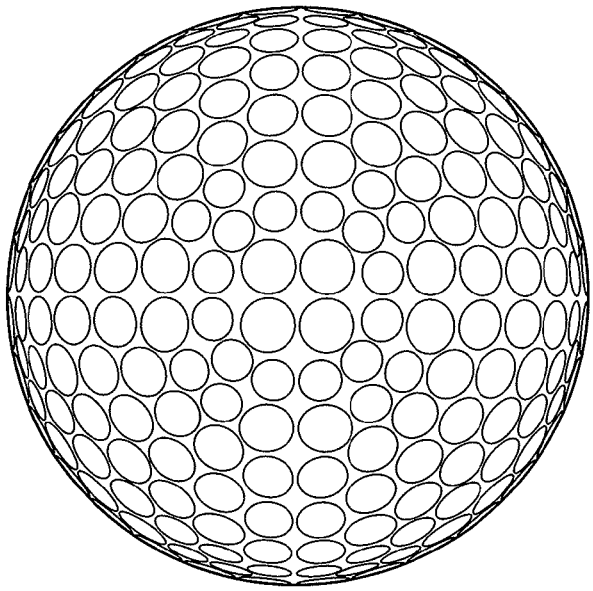
FIG. 3 is a top view of a ball showing the dimple pattern of Example 1.
Figure 4:
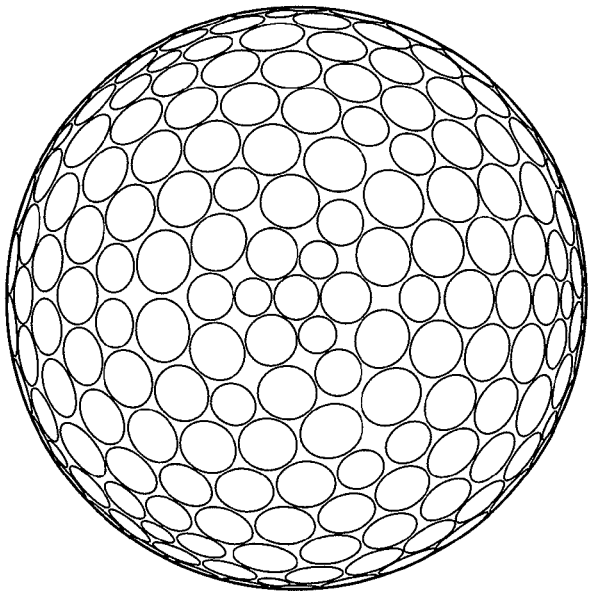
FIG. 4 is a top view of a ball showing the dimple pattern of Comparative Example 1.
Figure 5:
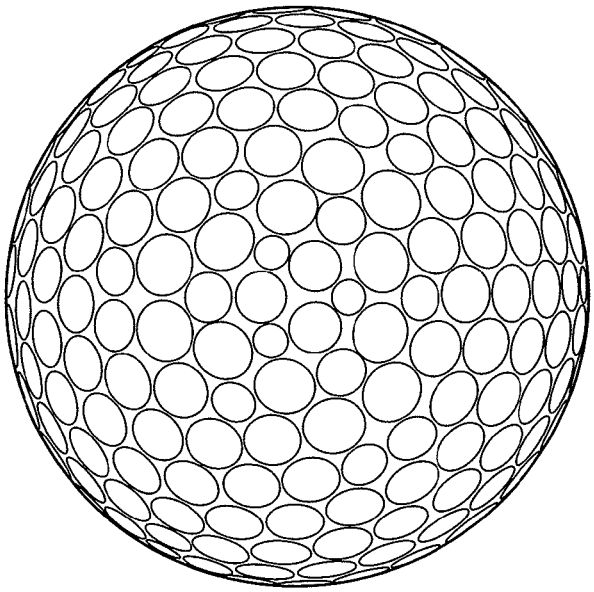
FIG. 5 is a front view of a ball showing the dimple pattern of Comparative Example 2.
Figure 6:
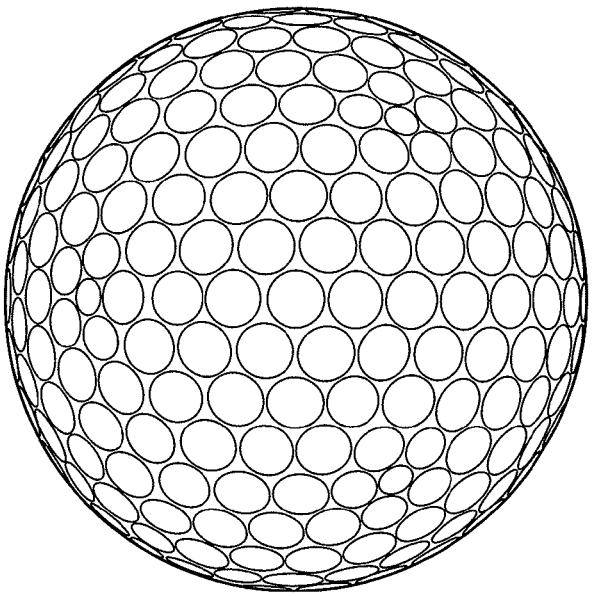
FIG. 6 is a front view of a ball showing the dimple pattern of Comparative Example 3.
Figure 7:
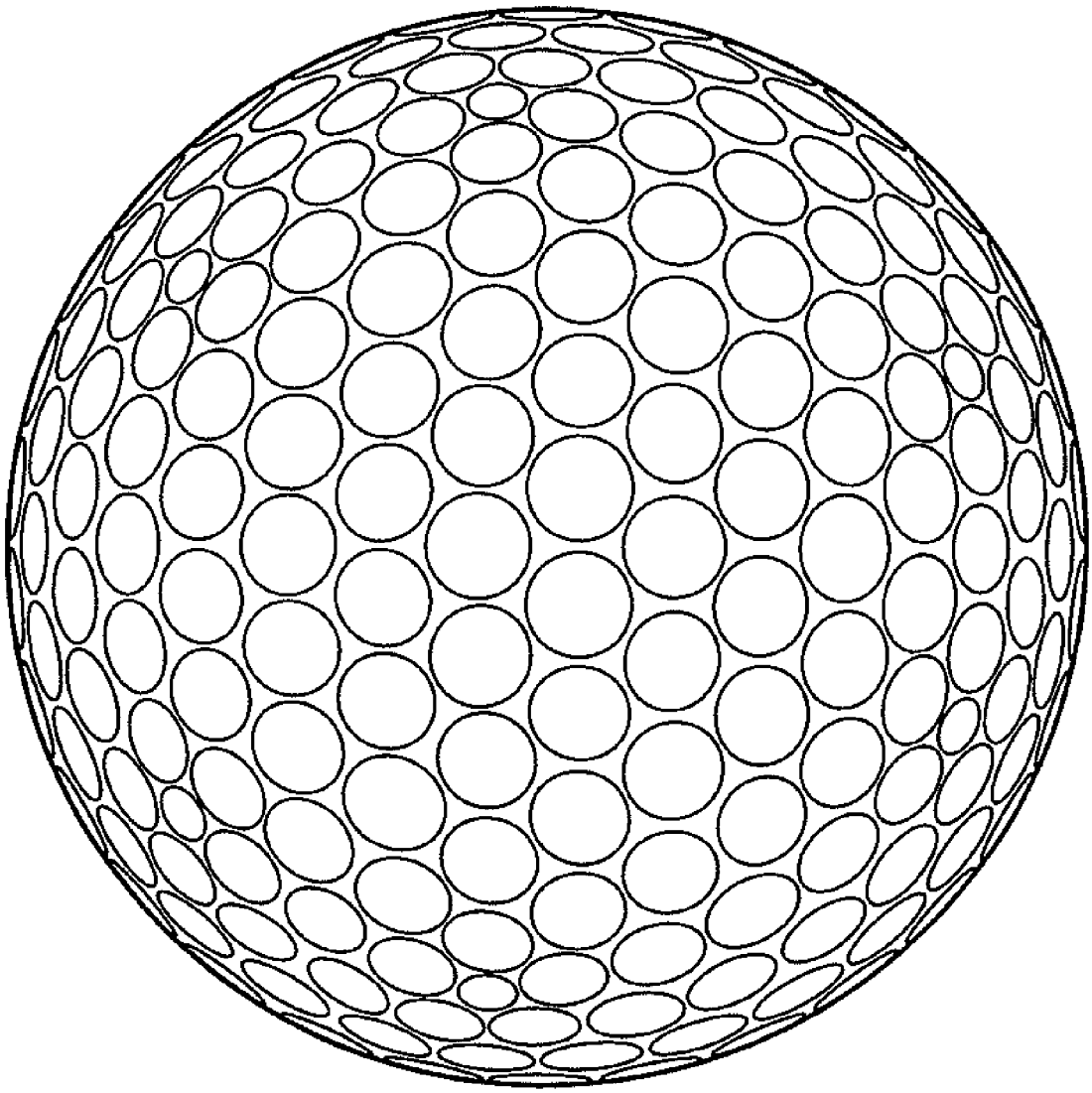
FIG. 7 is a front view of a ball showing the dimple pattern of Comparative Example 4.

With regard to the dimple patterns in the tables, the dimple pattern for Example 1 is shown in FIG. 3, the pattern for Comparative Example 1 is shown in FIG. 4, the pattern for Comparative Example 2 is shown in FIG. 5, the pattern for Comparative Example 3 is shown in FIG. 6, and the pattern for Comparative Example 4 is shown in FIG. 7. These figures all are top views of the ball. In each example, the bottom views have the same pattern as the top views, and are thus omitted.

TABLE 1

| Example 1 Dimple types | Number of dimples | Diameter (mm) | Depth (mm) | Volume ($mm^3$) |
|---|---|---|---|---|
| Da-I | 40 | 4.1 | 0.21 | 1.53 |
| Da-II | 184 | 3.9 | 0.20 | 1.31 |
| Db-I | 96 | 3.3 | 0.16 | 0.73 |
| Da-III | 32 | 4.1 | 0.23 | 1.72 |
| Da-IV | 16 | 3.9 | 0.22 | 1.45 |
| Db-II | 16 | 3.2 | 0.15 | 0.62 |
| Db-III | 8 | 3.2 | 0.14 | 0.49 |

TABLE 2

| Comparative Example 1 Dimple types | Number of dimples | Diameter (mm) | Depth (mm) | Volume ($mm^3$) |
|---|---|---|---|---|
| Da-I | 24 | 4.7 | 0.15 | 1.25 |
| Da-II | 168 | 4.5 | 0.15 | 1.15 |
| Da-III | 48 | 3.9 | 0.15 | 0.85 |
| Db-I | 12 | 2.9 | 0.15 | 0.44 |
| Db-II | 12 | 2.6 | 0.11 | 0.24 |
| Da-IV | 30 | 4.4 | 0.16 | 1.20 |
| Da-V | 36 | 3.9 | 0.17 | 0.94 |
| Db-III | 8 | 3.5 | 0.16 | 0.70 |
| Db-IV | 6 | 3.4 | 0.15 | 0.61 |

TABLE 3

| Comparative Example 2 Dimple types | Number of dimples | Diameter (mm) | Depth (mm) | Volume ($mm^3$) |
|---|---|---|---|---|
| Da-I | 12 | 4.6 | 0.16 | 1.28 |
| Da-II | 222 | 4.4 | 0.16 | 1.16 |
| Da-III | 36 | 3.8 | 0.15 | 0.80 |
| Db-I | 12 | 2.6 | 0.12 | 0.58 |
| Da-IV | 12 | 4.4 | 0.17 | 0.25 |
| Da-V | 24 | 3.8 | 0.16 | 1.25 |
| Db-II | 6 | 3.5 | 0.16 | 0.86 |
| Db-III | 6 | 3.4 | 0.15 | 0.7 |

TABLE 4

| Comparative Example 3 Dimple types | Number of dimples | Diameter (mm) | Depth (mm) | Volume ($mm^3$) |
|---|---|---|---|---|
| Da-I | 228 | 4.3 | 0.17 | 1.06 |
| Da-II | 36 | 3.7 | 0.16 | 0.74 |
| Db-I | 12 | 2.5 | 0.12 | 0.23 |
| Db-II | 12 | 3.4 | 0.17 | 0.72 |
| Da-IIII | 42 | 4.3 | 0.18 | 1.14 |
| Da-IV | 24 | 3.7 | 0.17 | 0.80 |
| Da-V | 12 | 4.3 | 0.17 | 1.05 |
| Da-VI | 6 | 3.9 | 0.16 | 0.89 |

TABLE 5

| Comparative Example 4 Dimple types | Number of dimples | Diameter (mm) | Depth (mm) | Volume ($mm^3$) |
|---|---|---|---|---|
| Db-I | 114 | 3.65 | 0.196 | 1.071 |
| Da-I | 114 | 4.0 | 0.153 | 1.013 |
| Db-II | 60 | 3.65 | 0.195 | 1.071 |
| Db-III | 12 | 2.5 | 0.167 | 0.431 |
| Db-II | 60 | 4.0 | 0.153 | 1.013 |

TABLE 6

| | | | Example | Comparative Example | | | |
|---|---|---|---|---|---|---|---|
| | | | 1 | 1 | 2 | 3 | 4 |
| Number of dimple types | | | 7 | 9 | 8 | 8 | 5 |
| Number of dimples | | | 392 | 344 | 330 | 368 | 360 |
| SR value (%) | | | 72 | 80 | 78 | 76 | 71 |
| VR value (%) | | | 1.2 | 0.9 | 0.88 | 0.93 | 0.90 |
| Average DP (mm) | | | 0.19 | 0.15 | 0.15 | 0.16 | 0.17 |
| Average DM/DP | | | 19.83 | 27.39 | 24.77 | 23.17 | 20.97 |
| (Total number of Db)/(Total number of Da) | | | 0.44 | 0.12 | 0.078 | 0.070 | 1.07 |
| Volume proportion of Da dimples (%) | | | 82 | 95 | 95 | 97 | 48 |
| Low-velocity CL ratio (%) | | | 85 | 80 | 78 | 65 | 75 |
| Flight | Ball striking conditions: W#1, HS 45 m/s, 2200 rpm | Carry (m) | 216.8 | 218.5 | 217.3 | 216.2 | 215.1 |
| | | Total distance (m) | 222.5 | 225.8 | 223.4 | 221.7 | 220.4 |
| | Ball striking conditions: W#1, HS 45 m/s, 3300 rpm | Carry (m) | 216.5 | 217.7 | 216.2 | 214.5 | 213.3 |
| | | Total distance (m) | 221.9 | 223.7 | 220.9 | 218.5 | 217.4 |
| | Difference in carry | | 0.3 | 0.8 | 1.1 | 1.7 | 1.8 |
| | Difference in total distance | | 0.6 | 2.1 | 2.5 | 3.2 | 3.0 |

The low-velocity CL ratio was obtained by calculating the ratio of the coefficient of lift CL of a ball launched using an Ultra Ball Launcher (UBL) at a Reynolds number of 70,000 and a spin rate of 2000 rpm with respect to the coefficient of lift CL of a ball launched at a Reynolds number of 80,000 and a spin rate of 2000 rpm.

Flight Performance

Ball striking tests were carried out at a head speed of 45 m/s and a loft angle of 9.5° using a TOURSTAGE X-DRIVE club mounted on a swing robot, in such a way as to generate spin rates of about 2200 rpm and about 3300 rpm.

As shown in the above table, compared with the golf balls in Comparative Examples 1 to 4, the golf balls of the working example of the invention exhibited lower variations in carry and total distance and were able to achieve a stable trajectory at both high and low spin rates.

The invention claimed is:

1. A golf ball comprising a surface having a plurality of dimples formed thereon, wherein the number of dimples is at least 250 and not more than 400, the dimples have a surface coverage (SR) of at least 70% and a volume ratio (VR) of at least 1.1%, are of at least three types and have an average depth of at least about 0.18 mm and a diameter to depth ratio (DM/DP) of not more than about 22, the (total number of Db)/(total number of Da) ratio, where Da represents dimples having a diameter of at least 3.7 mm and Db represents dimples having a diameter of less than 3.7 mm, is at least about 0.005 and not more than about 1, and the ball has a coefficient of lift CL at a Reynolds number of 70,000 and a spin rate of 2,000 rpm which is maintained at 60% or more of the coefficient of lift CL at a Reynolds number of 80,000 and a spin rate of 2,000 rpm, wherein a depth DP of a dimple is measured by connecting positions where the dimple meets land areas to trace a hypothetical flat plane L and determining a vertical distance from a center position on the flat plane L to a bottom of the dimple.

2. The golf ball of claim 1, wherein the dimples Da having a diameter of at least 3.7 mm account for at least about 75% of the total dimple volume.

3. The golf ball of claim 1 further comprising a core, a cover layer, and an intermediate layer interposed there between, wherein the intermediate layer is composed of at least one layer made of a material having a material hardness (Shore D) of from 55 to 75.

4. The golf ball of claim 3, wherein the cover layer is made of a material which is an ionomer resin.

5. The golf ball of claim 3, wherein the core has a diameter of from 36.8 to 41.8 mm and has a deflection, when compressed under a final load of 130 kg from an initial load of 10 kg, of from 3.5 to 5.0 mm.

6. The golf ball of claim 1, wherein the average diameter (Dm) of the Da dimples is at least about 3.7 mm and not more than about 6 mm, the average diameter (Dm) of the Db dimples is at least about 1 mm and not more than about 3.7 mm.

7. The golf ball of claim 1, wherein the average depth (Dp) of the Da dimples is at least about 0.05 mm and not more than about 0.5 mm, the average depth (Dp) of the Db dimples is at least about 0.05 mm and not more than about 0.3 mm.

8. The golf ball of claim 1, wherein the average volume of the Da dimples is at least about 0.8 $mm^3$ and not more than about 3.0 $mm^3$, the average volume of the Db dimples is at least about 0.2 $mm^3$ and not more than about 1.5 $mm^3$.

9. The golf ball of claim 1, wherein the ratio Dm/Dp for the Da dimples is at least about 7 and not more than about 25.

10. The golf ball of claim 1, wherein the ratio Dm/Dp for the Db dimples is at least about 10 and not more than about 30.

11. The golf ball of claim 3, wherein the intermediate layer is formed primarily of a resin mixture:

(A) an ionomeric resin containing (a-1) an olefin-unsaturated carboxylic acid random copolymer and/or a metal ion neutralization product of an olefin-unsaturated carboxylic acid random copolymer, and (a-2) an olefin-unsaturated carboxylic acid-unsaturated carboxylic acid ester ternary random copolymer and/or a metal ion neutralization product of an olefin unsaturated carboxylic acid-unsaturated carboxylic acid ester ternary random copolymer in a weight ratio (a-1)/(a-2) of between 100/0 and 0/100, and (B) a non-ionomeric thermoplastic elastomer in a weight ratio (A)/(B) of between 100/0 and 50/50.

12. A golf ball comprising a surface having a plurality of dimples formed thereon, wherein the number of dimples is at least 250 and not more than 400, the dimples have a surface coverage (SR) of at least 70% and a volume ratio (VR) of at least 1.1%, are of at least five types and have an average depth of at least about 0.18 mm and a diameter (DM) to depth (DP) ratio (DM/DP) of not more than about 22, the (total number of Db)/(total number of Da) ratio, where Da represents dimples having a diameter of at least 3.7 mm and Db represents dimples having a diameter of less than 3.7 mm, is at least about 0.005 and not more than about 1, the dimples DA having a diameter of at least 3.7 mm account for at least about 75% of the total volume of all dimples, and the ball has a coefficient of lift CL at a Reynolds number of 70,000 and a spin rate of 2,000 rpm which is maintained at 60% or more of the coefficient of lift CL at a Reynolds number of 80,000 and a spin rate of 2,000 rpm, and wherein the ball further comprises a core, a cover layer and an intermediate layer interposed there between, the core having a deflection, when compressed under a final load of 130 kg from an initial load of 10 kg, of from 3.5 to 5.0 mm, and the cover layer containing an ionomeric or urethane resin and having a material hardness (Shore D) of from 55 to 75 and a thickness of from 0.7 to 2.0 mm, wherein a depth DP of a dimple is measured by connecting positions where the dimple meets land areas to trace a hypothetical flat plane L and determining a vertical distance from a center position on the flat plane L to a bottom of the dimple.

* * * * *